US005109575A

United States Patent [19]

Angarola et al.

[11] Patent Number: 5,109,575

[45] Date of Patent: May 5, 1992

[54] TOOTHED SEAL FOR HARD THERMOPLASTIC STRAP

[75] Inventors: Barry R. Angarola, Schaumburg; William F. Duenser, Mount Prospect, both of Ill.

[73] Assignee: Signode Corporation, Glenview, Ill.

[21] Appl. No.: 714,001

[22] Filed: Jun. 10, 1991

[51] Int. Cl.[5] ..... B65D 63/14

[52] U.S. Cl. ..... 24/16 PB; 24/23 W

[58] Field of Search ..... 24/16 R, 16 PB, 20 R, 24/21, 22, 23 R, 23 W, 23 EE

[56] References Cited

U.S. PATENT DOCUMENTS 3,197,831 8/1965 Martin et al. ..... 24/16 R 3,636,592 1/1972 Beach ..... 24/23 W 3,736,627 6/1973 Sosinski ..... 24/23 W

*Primary Examiner*—James R. Brittain

*Attorney, Agent, or Firm*—T. W. Buckman; D. J. Breh

[57] ABSTRACT

A seal is provided for joining a pair of overlapping plastic strap portions. The seal includes a body of sheet material having a strap engaging surface which engages the strap portions when the seal is closed about the strap portions. The body has a plurality of teeth projecting from the strap-engaging surface. Each tooth is formed of material displaced outwardly from the strap-engaging surface to define a recess therein. Each tooth has a solid configuration defined by converging side surfaces and truncated along a top surface.

17 Claims, 7 Drawing Sheets

Fig. 1
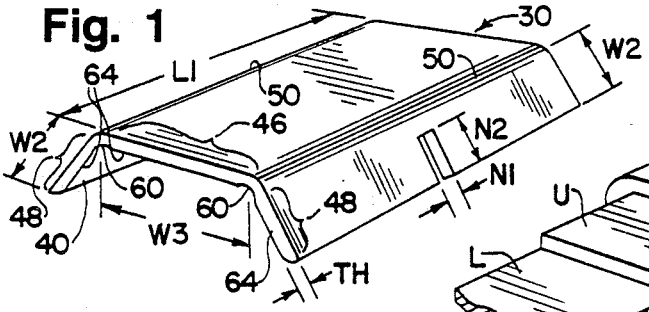
Fig. 2
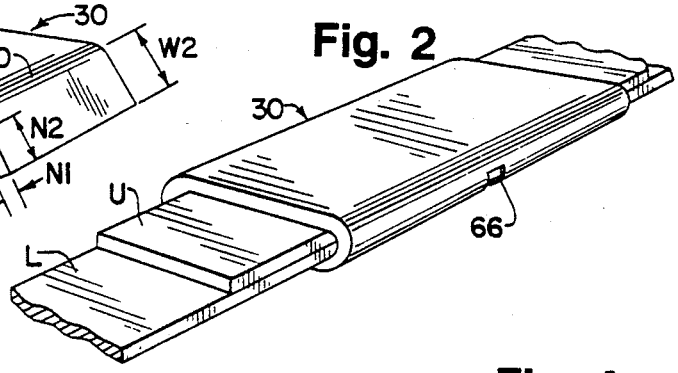
Fig. 3
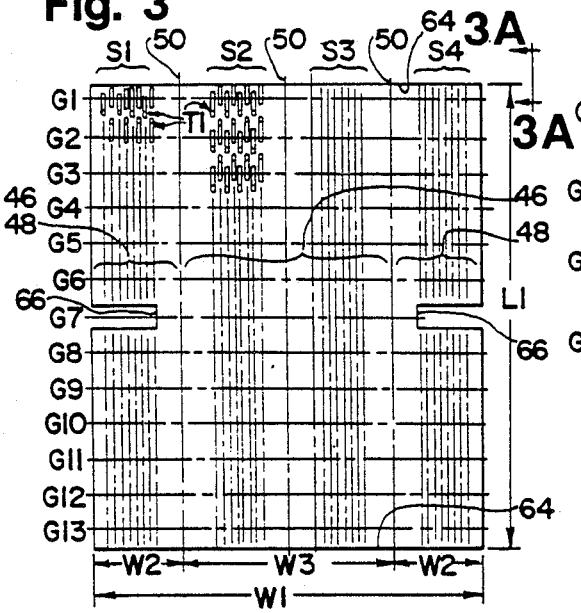
Fig. 4
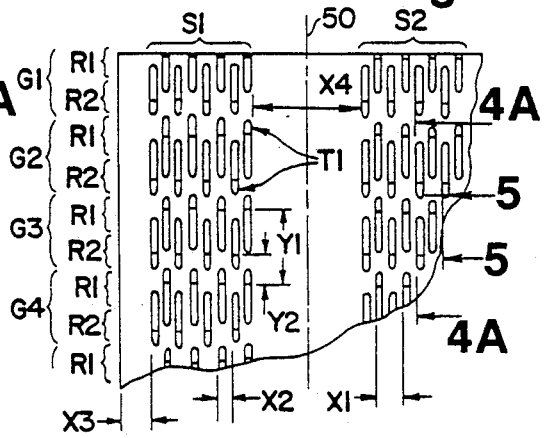
Fig. 6
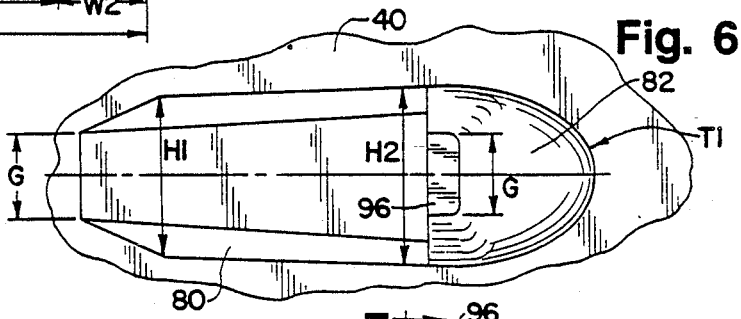
Fig. 7
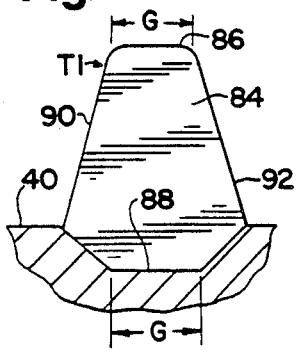
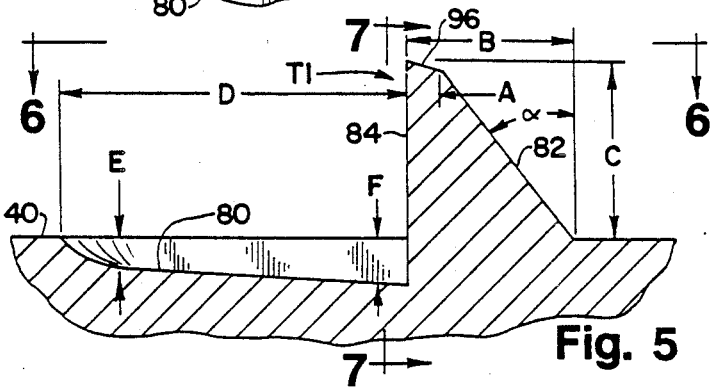
Fig. 5

Fig. 4A
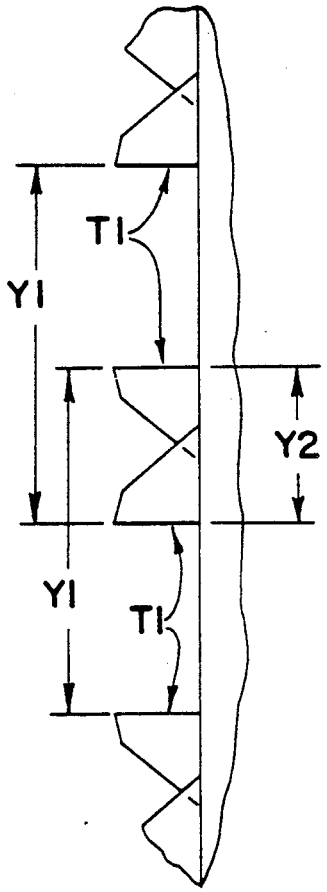
Fig. 3A
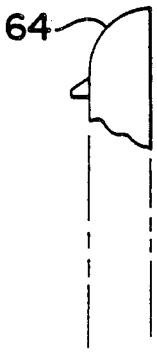
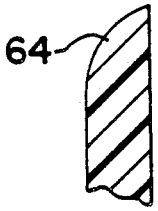
Fig. 15A

Fig. 9
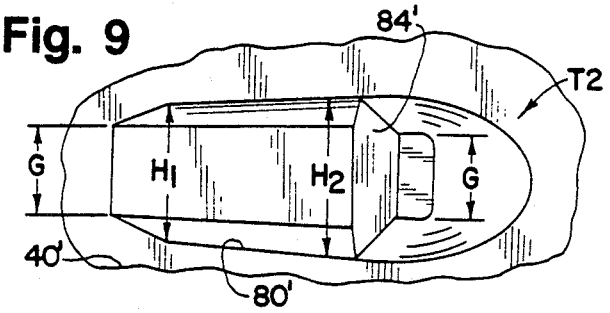
Fig. 10
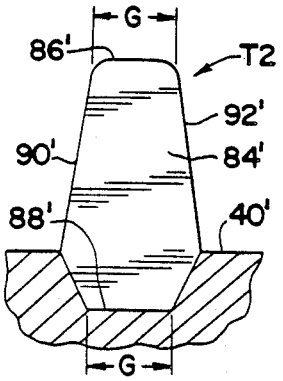
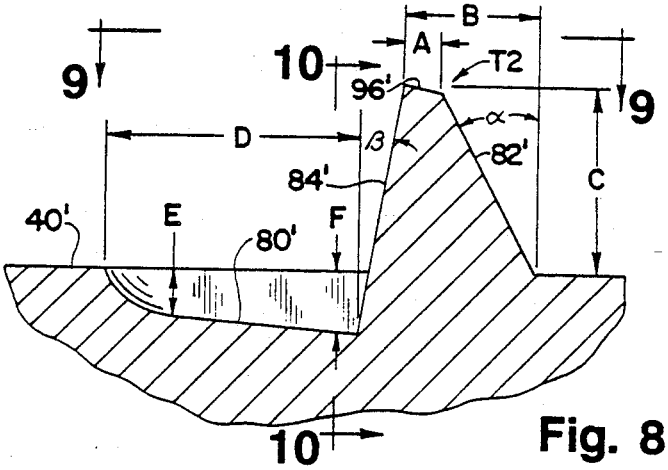
Fig. 8
Fig. 12 PRIOR ART
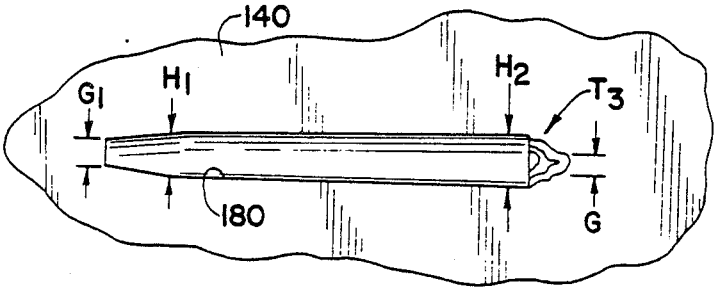
Fig. 13
PRIOR ART
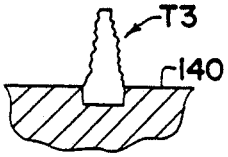
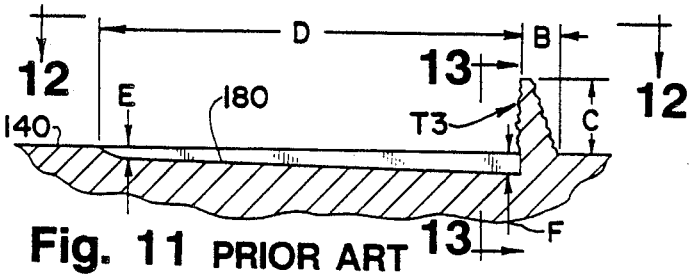
Fig. 11 PRIOR ART Fig. 17
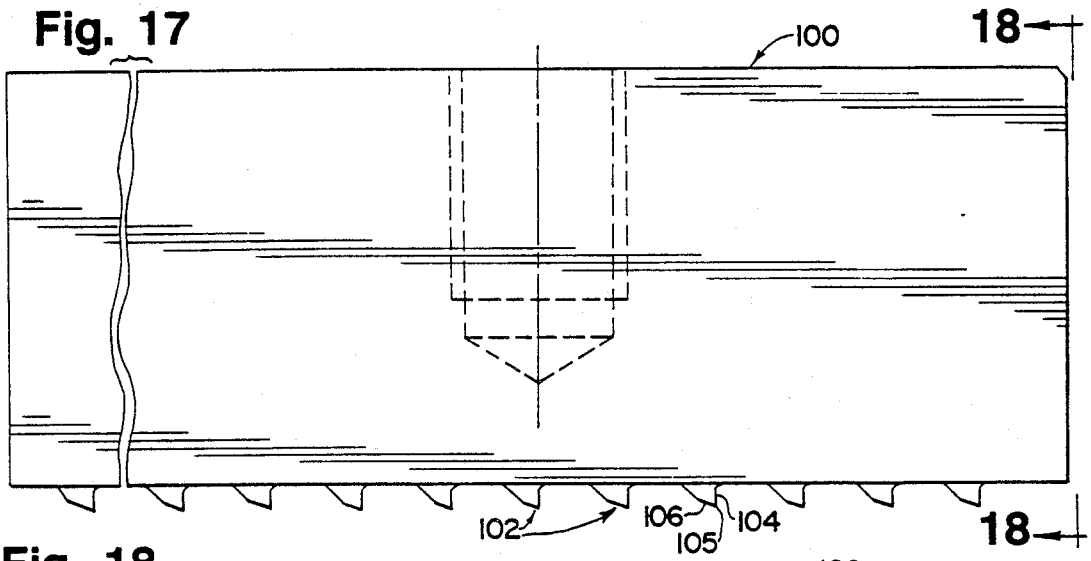
Fig. 18
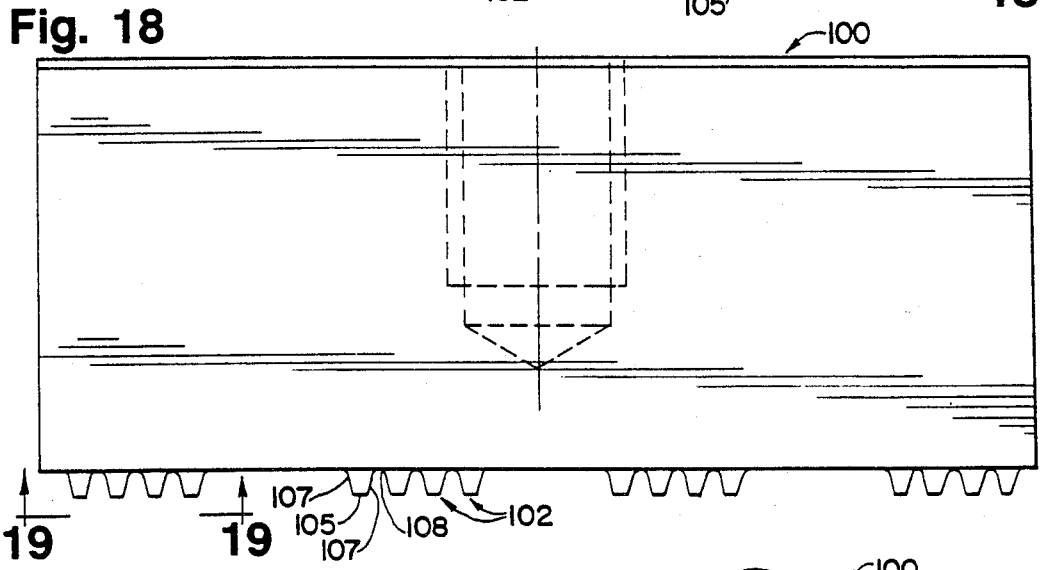
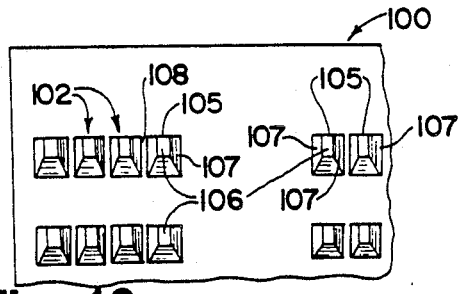
Fig. 19
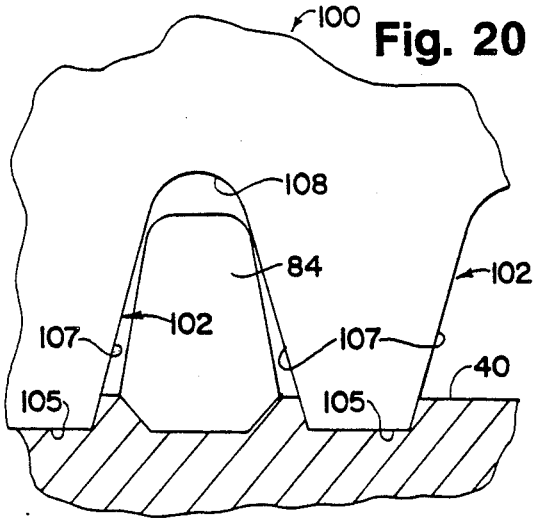
Fig. 20
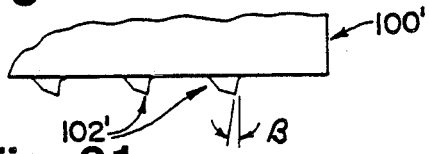
Fig. 21

Fig. 22A

| SEAL CONFIGURATION TYPE | 1 (PRIOR ART TEETH) | 2 (PRIOR ART TEETH) | 3 | 4 | 5 | 6 |
|---|---|---|---|---|---|---|
| APPLICABLE FIGURES | 1-2, 11-13,15 | 1-2 11-13,15 | 1-7 | 1-4, 8-10 | 1-7 | 1-4, 8-10 |
| TOOTH PROFILE / TOOTH DIMENSIONS (INCHES) | | | | | | |
| A | POINT | POINT | 0.003 TO 0.005 | 0.003 TO 0.005 | 0.003 TO 0.005 | 0.003 TO 0.005 |
| B | 0.007-0.009 | 0.005 0.007 | 0.017-0.020 | 0.017-0.020 | 0.022-0.025 | 0.022-0.025 |
| C | 0.020 TO 0.025 | 0.015 TO 0.020 | 0.016 TO 0.019 | 0.016 TO 0.019 | 0.019 TO 0.023 | 0.019 TO 0.023 |
| D | 0.075 | 0.065 | 0.045 | 0.050 | 0.035 | 0.040 |
| E | 0.001 | 0.001 | 0.003 | 0.003 | 0.005 | 0.005 |
| F | 0.002 | 0.002 | 0.005 | 0.005 | 0.007 | 0.007 |
| G | 0.005 | 0.005 | 0.015 | 0.015 | 0.015 | 0.015 |
| H1 | 0.005-0.006 | 0.005-0.006 | 0.017-0.021 | 0.017-0.021 | 0.019-0.023 | 0.019-0.023 |
| H2 | 0.009 | 0.007 | 0.020-0.025 | 0.020-0.023 | 0.022-0.026 | 0.022-0.026 |
| TOOTH SURFACE ANGLES (DEGREES) | | | | | | |
| $\alpha$ | 20-25 | 20-25 | 40-50 | 30-40 | 40-50 | 30-40 |
| $\beta$ | — | — | — | 10 | — | 10 |
| SEAL SIZE | | | | | | |
| L1 (INCHES) | 1.615 | 1.615 | 1.615 | 1.615 | 1.615 | 1.615 |
| W1 (INCHES) | 1.410 | 1.410 | 1.410 | 1.410 | 1.410 | 1.410 |
| W2 (INCHES) | 0.340 | 0.340 | 0.340 | 0.340 | 0.340 | 0.340 |
| W3 (INCHES) | 0.730 | 0.730 | 0.730 | 0.730 | 0.730 | 0.730 |
| THICKNESS TH (INCHES) | 0.049 | 0.049 | 0.049 | 0.049 | 0.049 | 0.049 |
| NOTCH WIDTH N1 (INCHES) | 0.062 | 0.062 | 0.062 | 0.062 | 0.062 | 0.062 |
| NOTCH WIDTH N2 (INCHES) | 0.215 | 0.215 | 0.215 | 0.215 | 0.215 | 0.215 |
| SEAL END EDGES 64 COINED TO A RADIUS (IN.) | 0.020 | 0.020 | 0.020 | 0.020 | 0.040 | 0.040 |

Fig. 22B

| SEAL CONFIGURATION TYPE | 1 (PRIOR ART TEETH) | 2 (PRIOR ART TEETH) | 3 | 4 | 5 | 6 |
|---|---|---|---|---|---|---|
| TOOTH ARRAY LAYOUT | FIG. 15 | FIG. 15 | FIG. 4 | FIG. 4 | FIG. 4 | FIG. 4 |
| TOOTH ARRAY DIMENSIONS (INCHES) | | | | | | |
| X1 | 0.030 | 0.030 | 0.045 | 0.045 | 0.045 | 0.045 |
| X2 | 0.015 | 0.015 | 0.0225 | 0.0225 | 0.0225 | 0.0225 |
| X3 | 0.030 | 0.030 | 0.035 | 0.035 | 0.035 | 0.035 |
| X4 | 0.162 | 0.162 | 0.174 | 0.174 | 0.174 | 0.174 |
| Y1 | 0.080 | 0.080 | 0.125 | 0.125 | 0.125 | 0.125 |
| Y2* | 0.030 | 0.030 | 0.040 | 0.040 | 0.040 | 0.040 |
| *AS MEASURED BETWEEN TEETH AT THE TOPS OF THE TEETH. | | | | | | |
| NUMBER OF STRIPS S | 4 | 4 | 4 | 4 | 4 | 4 |
| NUMBER OF GROUPS G PER STRIP S | 20 | 20 | 13 | 13 | 13 | 13 |
| NUMBER OF ROWS R PER GROUP G | 2 | 2 | 2 | 2 | 2 | 2 |
| NUMBER OF TEETH PER ROW | 8 | 8 | 4 | 4 | 4 | 4 |
| NUMBER OF TEETH PER SEAL | 1280 | 1280 | 416 | 416 | 416 | 416 |
| JOINT STRENGTH (POUNDS) | 580 TO 620 | 582 TO 714 | 678 TO 760 | 678 TO 760 | 860 TO 910 | 860 TO 910 |
| JOINT STRENGTH AS A PERCENTAGE OF STRAP STRENGTH | 50-54 | 51-62 | 60-66 | 60-66 | 75-79 | 75-79 |

TOOTHED SEAL FOR HARD THERMOPLASTIC STRAP

TECHNICAL FIELD

This invention relates to improvements in the securement of the overlapping ends of a tensioned strap loop around a package or other object. More particularly, the present invention relates to an improved metal seal for being crimped around the overlapping lengths of thermoplastic strap to hold the strap lengths together.

BACKGROUND OF THE INVENTION AND TECHNICAL PROBLEMS POSED BY THE PRIOR ART

A variety of tools and machines have been proposed and/or are in use for tensioning a loop of strap around an article or articles, such as a stack of lumber, equipment on a pallet, and the like. Many such machines and tools also typically apply a deformable seal to secure the overlapping strap lengths together and then sever the trailing portion of the strap from a supply of the strap on a reel.

Typically, conventional strapping machines and tools of this type operate to grip a leading, free end segment of the strap with a suitable gripping device and then apply tension with a traction wheel which is rotated against the strap. After sufficiently high tension has been pulled on the strap, the tension is maintained on the strap while an open, generally C-shaped or U-shaped seal, which has been supplied from a magazine, is crimped about the overlapping strap portions to hold them together in tight engagement. At the termination of the crimping step, the trailing portion of the strap is severed by a suitable mechanism.

Conventional strapping tools of the type described above have been marketed in the U.S.A. by Signode Corporation, 3600 West Lake Avenue, Glenview, Ill. 60025. One such tool is marketed under the designation ÷SIGNODE Model ASD Combination Strapping Tool" and is disclosed in the "OPERATION AND PARTS MANUAL" for that tool as published by Signode Corporation under the document designation "REB 7/77-1M-A". Another such machine is marketed under the designation "SIGNODE AM COMBINATION STRAPPING TOOL" and is disclosed in the "OPERATION, PARTS AND SAFETY MANUAL" for that tool as published by Signode Corporation under the document designation "186027 (p.20E) Rev. 10-89". Other tools of this general type have been marketed under the designation "SIGNODE ASL and ASM COMBINATION STRAPPING TOOLS" and are disclosed in the "OPERATION, PARTS AND SAFETY MANUAL" for such tools as published by Signode Corporation under the document designation 186101 (p. 69A) Rev. 2-90".

The above-identified tools are manually operated and typically include a housing, a tensioning assembly, a seal magazine assembly, a sealer assembly for applying the seal to the overlapping lengths of the strap after the strap has been tensioned, and a cutter mechanism for severing the sealed loop from the trailing portion of strap. Other tools performing the same functions may be pneumatically or electrically operated. Further, the functions may also be incorporated in large, automatic machines which also operate to initially feed the strap around the article to be bound and form a loop which is subsequently tensioned, sealed, and severed from the supply of strap.

The above-identified types of tools and machines typically employ a pair of pivoting jaws for crimping the seal about the overlapping lengths of strap. Typically, the seal is steel, and the strap may be steel or a thermoplastic material. In either case, the jaws pivot to a closed position to deform the steel seal tightly about the overlapping strap lengths.

Different types of steel seals have been developed over the years for use with thermoplastic strap. Some seals are provided with teeth, such as disclosed in the Signode Corporation U.S. Pat. No. 3,636,592. The tooth structure disclosed in that patent has been incorporated in a commercially available seal marketed in the U.S.A. under the designation "50 ASD" by Signode Corporation, 3600 West Lake Avenue, Glenview, Ill. 60025. The 50 ASD seal has been widely used for a long time with the "softer" thermoplastic strap materials, such as nylon and polypropylene.

Although the 50 ASD seal functions well with nylon and polypropylene thermoplastic strap, it is not sold for use with the harder polyester thermoplastic strap. It has been found that relatively thin, sliver-like teeth, such as are used in the 50 ASD seal, tend to bend and deform when the seal is closed about the overlapping portions of polyester strap. Thus, many of the teeth in the seal may not function particularly well to penetrate and grip the strap material. A seal with such teeth would not provide as great a joint strength as would be desired in some applications when used on polyester strap.

If the overlapping strap lengths are not sufficiently restrained by the seal teeth, then the overlapping straps may slip within the seal, and the strap loop will become loose. Indeed, the joint may not be initially tight enough, or the joint may loosen with time and/or upon being subjected to external loading conditions such as vibrations or impacts during handling. This problem is further exacerbated by the relatively low friction coefficients exhibited by thermoplastic strap.

The surface of plastic strap may be relatively smooth and have a relatively low coefficient of sliding friction. In addition, plastic strap has a tendency to stretch and undergo a transverse reduction in the width dimension when subjected to substantial tensile forces over a period of time. Obviously, these characteristics can decrease the joint strength capability or integrity of a joint formed with a compressed seal at given compression force.

Some straps may be specially treated or coated (e.g., with wax or other materials) to improve appearance, improve automatic feeding characteristics within automatic strapping machines, or for other reasons. Such treated straps may have a lower coefficient of sliding friction than untreated strap and may slip more easily in a joint formed by a compressed, metal seal.

Also, in many industrial packaging situations, oil or grease may be accidentally or purposely applied to the strap. In any case, application of a compressed seal about such strap segments to effect a friction joint therebetween may not establish a tight enough joint that will hold under the tension applied to the strap. Even if the seal at first securely grips the overlapping strap segments, the strap segments may start to slide within the seal over a period of time or when subjected to vibration and other shock loading conditions.

To overcome these problems of seal/strap slippage, a number of seal modifications have been developed. The U.S. Pat. No. 3,089,233 to Meier discloses a seal blank which is coated on the inside with relatively hard, small grit particles. When overlapped end portions of a strap are secured together by the seal, the particles are embedded in the adjacent faces of the strap end segments and hold the strap end segments against relative longitudinal movement. The U.S. Pat. No. 3,237,256 to Young also discloses a plastic strap seal wherein grit material is secured to the inner, strap-contacting surfaces of the seal.

Though the above-discussed grit-type seals function satisfactorily to cut through layers of wax, oil, or paint on strapping and form a secure joint for some types of strap, the grit on the seals poses a problem since some of the particles of grit tend to become detached from the seal and are then carried, or fall, into the tool or machine used to compress the seal about the overlapped strap portions. Eventually, a build-up of grit within the tool or machine causes operational problems. Thus, it would be desirable to provide a gritless seal free of any sources of particulate matter which could enter a seal-applying machine or tool and have deleterious effects.

Such an improved, gritless seal should function to provide relatively high joint strength when used with the harder thermoplastic strapping materials, such as polyester strapping material.

Further, it would be desirable if such an improved seal could be adapted for use with the relatively thick, conventional, polyester strap having a width of about $\frac{5}{8}$ inch and a thickness of about 0.033 inch.

Additionally, it would be beneficial if such an improved seal could be manufactured relatively inexpensively by means of a readily controllable process capable of producing a readily controlled seal configuration with more controlled strap-gripping characteristics.

It would be desirable to provide such an improved seal with a design susceptible of embodiment in a form that could reduce or minimize strap stress concentrations and that could provide a more uniform gripping engagement of the strap material.

It would be beneficial if such an improved seal could be provided with a design that exhibits little or no "directionality" relative to the tension forces in the overlapping strap portions. That is, it would be desirable to provide gripping structures on such an improved seal that exhibit substantially the same holding power in opposite directions along the length of the strap.

Finally, it would be advantageous if such an improved seal had a strap-engaging structure that would accommodate the heat treatment of the seal or the coating of the seal with hot metal or glass spray.

SUMMARY OF THE INVENTION

A seal is provided for joining a pair of overlapping plastic strap portions. The seal includes a body of sheet material having a strap-engaging surface to engage the strap portions when the seal is closed about the strap portions.

The body has a plurality of teeth projecting from the strap-engaging surface. Each tooth is formed of material displaced outwardly from the strap-engaging surface to define a recess therein.

Each tooth has a solid configuration defined by converging side surfaces and truncated along a top surface.

In a preferred embodiment, the height of each tooth above the strap-engaging surface is such that the ratio of the length of the recess to the height of the associated tooth is within the range of about 1 to 1 to 3 to 1. Further, in the preferred embodiment, each tooth includes one substantially trapezoidal side surface, and the top surface of the tooth has a generally flat configuration which is parallel to the portion of the strap-engaging surface that is immediately adjacent to the tooth.

This tooth structure provides the seal with increased joint strength capability with respect to harder thermoplastic strap, such as polyester strap.

The tooth structure can be formed so that it is substantially non-directional with respect to the tension forces in the strap portions.

The tooth structure is relatively strong, and the tooth structure can be heat treated or sprayed with hot metal or glass to add rigidity.

The tooth structure also permits the teeth to be provided on the seal in an array that is relatively uniform and minimizes stress concentrations in the strap.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like throughout the same, FIG. 1 is a perspective view of an open seal body which can incorporate the tooth structure of various prior art as well as the tooth structure of the present invention;

FIG. 2 is a perspective view of the seal in FIG. 1 in a fully closed condition on a pair of overlapping strap portions;

FIG. 3 is a fragmentary, simplified, plan view of the strap-engaging surface of the seal with a tooth profile of the present invention formed thereon before the side margins of the seal are bent to form the flattened C-shaped configuration illustrated in FIG. 1;

FIG. 3A, on the sheet of drawings with FIGS. 4A AND 15A, is a greatly enlarged, fragmentary, side elevational view generally along the plane 3A—3A in FIG. 3;

FIG. 4 is an enlarged, simplified, fragmentary view similar to FIG. 3;

FIG. 4A, on the sheet of drawings with FIGS. 3A and 15A, is an enlarged, fragmentary, cross-sectional view taken generally along the plane 4A—4A in FIG. 4;

FIG. 5 is a greatly enlarged, fragmentary, cross-sectional view taken generally along the plane 5—5 in FIG. 4;

FIG. 6 is a fragmentary, plan view taken generally along plane 6—6 in FIG. 5;

FIG. 7 is a fragmentary, cross-sectional view taken generally along the plane 7—7 in FIG. 5;

FIG. 8 is a view similar to FIG. 5 but showing a second form of a tooth profile of the seal of the present invention;

FIG. 9 is a fragmentary, plan view taken generally along the plane 9—9 in FIG. 8;

FIG. 10 is a fragmentary, cross-sectional view taken generally along the plane 10—10 in FIG. 8;

FIG. 11 is a view similar to FIG. 8 but showing a prior art tooth profile;

FIG. 12 is a fragmentary, plan view taken generally along the plane 12—12 in FIG. 11;

FIG. 13 is a fragmentary, cross-sectional view taken generally along the plane 13—13 in FIG. 11;

FIG. 15A, on the sheet of drawings with FIGS. 3A and 4A, is a greatly enlarged, fragmentary, side elevational view taken generally along the plane 15A—15A in FIG. 15;

FIG. 17 is a side elevational view of a tool die for forming the present invention seal tooth profile as illustrated in FIGS. 5-7;

FIG. 18 is an end elevational view taken generally along the plane 18—18 in FIG. 17;

FIG. 19 is a fragmentary, top plane view taken generally along the plane 19—19 in FIG. 18;

FIG. 20 is a greatly enlarged, fragmentary, cross-sectional view of a tool die of FIGS. 17-19 shown engaged with a seal blank to form the present invention seal teeth illustrated in FIGS. 5-7;

FIG. 21 is a view similar to FIG. 17, but showing an alternate embodiment of the tool die for cutting the teeth on the form of the present invention seal illustrated in FIGS. 8-10; and FIGS. 22A and 22B are tabulations of data relating to tests of six seal configurations.

DESCRIPTION OF THE PREFERRED EMBODIMENTS

Figure 14:
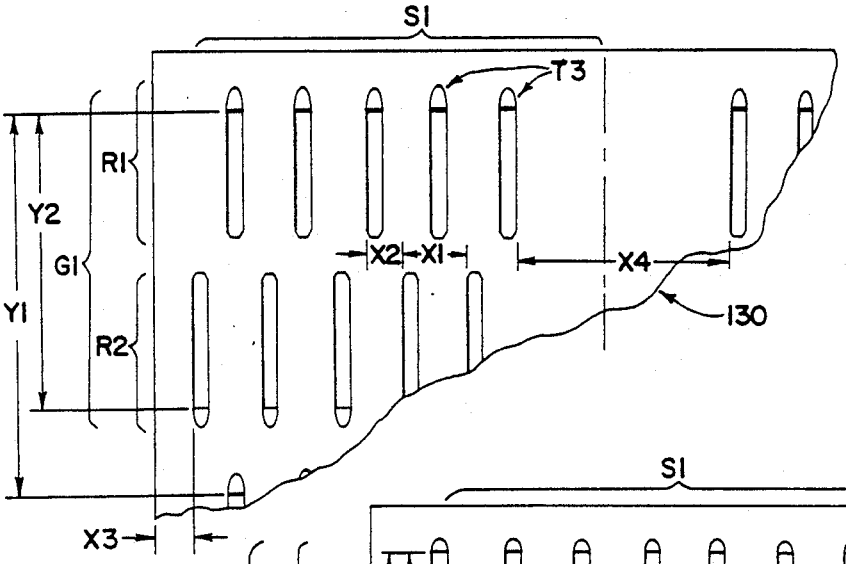
Fig. 14 PRIOR ART
FIG. 14 is a fragmentary, plan view of a seal blank similar to the blank shown in FIG. 3 but illustrating an arrangement of the prior art teeth shown in FIGS. 11-13.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

A seal is designated generally by the reference numeral 30 in FIG. 1 wherein it is shown in its entirety in an open position. The seal 30 has a well known and widely used, flattened C-shape. Alternatively, the open seal 30 could have a partially closed C-shape (not illustrated) wherein the confronting seal edges are only slightly spaced apart or wherein the confronting seal edges are even partially overlapped. The seal 30 may incorporate a tooth structure (not illustrated in FIG. 1) of various prior art designs as well as a tooth structure of the present invention described in detail hereinafter.

The seal 30 has a strap-engaging surface 40 which is adapted to engage overlapping strap portions U and L when the seal 30 is closed about the strap portions U and L as illustrated in FIG. 2.

The seal 30 includes a crown or central portion 46 and a pair of legs 48 which are each connected in a unitary manner to the central portion 46 along a longitudinally extending bend region 50.

The seal 30 is provided in a size appropriate for the size of the overlapping strap portions U and L which are to be joined together. In a preferred embodiment, the seal 30 is designed for use with polyester plastic strap having a nominal thickness of 0.86 mm (0.034 inch) and a nominal width of 16.2 mm (⅝ inch). Polyester strap having these dimensions is sold by the previously identified Signode Corporation in the U.S.A. under the trade name "16 mm High Strength Tenax", and such strap is typically harder than other widely used strap materials such as nylon and polypropylene. It is clear green in color, it is manufactured from polyethylene terephthalate resin with a melt point temperature of between about 470° F. and about 495° F., and it has a typical breaking strength of about 1,200 pounds.

For use with such straps the seal 30 is preferably fabricated in the form of a body of cold rolled steel sheet material having a soft temper and a hardness of RB 55-65.

A preferred length L1 (FIG. 1) of the seal 30 for use with the above-identified polyester strap is 1.615 inch. The central portion 46 of the seal preferably has a rectangular shape and a width W3 of 0.730 inch. Preferably, each leg 48 has a rectangular shape and a width W2 of about 0.350 inch. The thickness TH of the seal 30 is preferably about 0.049 inch.

The central portion 46 of the seal is defined between longitudinal deformations 60 which each have a radius of about 0.1 inch. This facilitates the folding of the seal around the strap portions U and L. Further, at each end of the seal, the inside edge 64 (FIG. 3A) is preferably coined or formed to a radius of between about 0.010 inch and about 0.040 inch to prevent damage to plastic strap during the crimping of the seal 30 about the strap.

The open seal 30 can be stacked with other identical seals. To this end, a plurality of seals 30 may be stacked one on top of the other in a nesting relationship. In order to secure the stack of seals, each seal is preferably provided with a notch 66 in each leg 48. A filament (not illustrated) can be disposed in a conventional manner in the notches 66 of the stacked seals 30 for tying and retaining the seals together in the stack. In a preferred embodiment, each notch 66 has a width N1 of 0.062 inch and a length N2 of 0.215 inch. A suitable filament that can be used is a low density polyethylene filament having a cylindrical cross-section and a diameter of about 0.071 inch. This type of filament retaining system for a stack of seals is described in the Signode Corporation U.S. Pat. No. 3,722,669 and forms no part of the present invention.

The seal 30 can be applied to the overlapping strap portions U and L by means of a suitable tool or machine, such as one of those described above in the section entitled "BACKGROUND OF THE INVENTION AND TECHNICAL PROBLEMS POSED BY THE PRIOR ART." When the seal 30 is closed about the overlapping strap portions U and L as illustrated in FIG. 2, overlapping strap portions U and L are restrained against relative movement by mechanical friction clamping forces imposed upon the strap portion surfaces by the seal 30.

The strap engaging surface 40 of the seal 30 is provided with a plurality of projections or teeth T1 as illustrated in FIGS. 3 and 4 wherein the seal 30 is shown in a flat sheet form before the seal margins (which have a width W2) are bent at an angle to form the seal legs 48 (FIG. 1).

In a preferred manufacturing process, each flat seal as illustrated in FIG. 3 would be initially formed on a longer sheet of material along with a plurality of other identical flat seals in an end-to-end array on the single sheet. For purposes of illustration, FIGS. 3 and 4 illustrate only one seal 30 in the flat sheet form.

To accommodate the closure of the seal 30 about the overlapping strap portions, the seal 30 is sufficiently ductile at least along each preformed deformation 60 which defines a bend region or line 50. However, in order to permit the seal 30 to effectively clamp the overlapping strap portions U and L, at least a portion of the thickness on the strap-engaging side of the seal 30 has a hardness which exceeds the hardness of the strap material.

The teeth T1 are formed from the seal material by upsetting the material from the strap-engaging surface 40. As best illustrated in FIGS. 5–7, each tooth T1 is formed of material that is displaced outwardly from the strap-engaging surface 40 to define a recess 80 therein. The tooth T1 has a solid configuration defined by converging side surfaces which include, in the embodiment illustrated in FIG. 5–7, a curved surface 82 and a generally upright, planar surface 84.

The surface 84 has a generally trapezoidal configuration as best illustrated in FIG. 7. The trapezoidal surface 84 is defined on the top by an edge 86 and on the bottom by an inner corner or edge 88. The edges 86 and 88 are parallel. A slanting edge 90 extends between one end of the edge 86 and one end of the edge 88, and a slanting edge 92 extends between the other end of the edge 86 and the other end of the edge 88.

The tooth T1 is truncated along a slightly slanting, top surface 96. The top surface 96 preferably has a thickness A of between about 0.003 inch and about 0.005 inch. Preferably, surface 96 has a width G of about 0.015 inch.

In a preferred configuration, the tooth T1 has a height C of between about 0.015 inch and about 0.025 inch, a recess depth E of between about 0.003 inch and about 0.005 inch, and a recess depth F of between about 0.005 inch and about 0.007 inch.

At the base of the tooth, along the strap-engaging surface 40, the tooth preferably has a width H2 of between about 0.015 inch and about 0.025 inch. The tooth thickness B at the tooth base is preferably about 0.025 inch.

The upright face 84 of the tooth T1 is generally perpendicular to the strap-engaging surface 40. The surface 82, however, is curved so that the two surfaces 82 and 84 together may be characterized as converging toward the top surface 96. FIG. 5 is a cross-sectional view showing the profile of the tooth T1, and the view is taken along a plane normal to the seal strap-engaging surface 40 across the tooth thickness at the mid-point of the tooth width. The tooth profile is defined along this plane by the upright surface 84 and the curved surface 82 which extend from opposite edges of the tooth top surface 96 at an included angle which is preferably between about 30 degrees and about 60 degrees so that the angle $\alpha$ (FIG. 5) would be between about 30 degrees and about 60 degrees.

In one preferred embodiment, the teeth T1 are arranged in an array on the seal 30 as illustrated in FIGS. 3 and 4. The teeth are arranged in columnar strips S1, S2, S3, and S4 which are parallel to the bend lines 50. Depending on the seal size and tooth size, a greater or fewer number of strips could be employed. Each seal leg 48 has one strip, S1 or S4, and the seal central portion 46 has two strips, S2 and S3. Each strip S1–S4 is made up of 13 groups of teeth, G1–G13, arranged longitudinally on the seal to form the elongate strips S1–S4.

Each teeth group G1–G13 includes two rows of teeth, R1 and R2. Each row R1 and R2 includes four teeth T1. Each tooth T1 in any row R1 is oriented with the upright surface 84 facing one end of the seal, and each tooth T1 in any row R2 is oriented with its upright surface 84 facing the other end of the seal.

The teeth T1 in each row R1 alternate with the teeth T1 in the row R2 of each group G1–G13 transversely across the seal in each strip S1–S4. Further, the teeth T1 in each row R1 are longitudinally offset relative to the teeth T1 in the row R2 in any of the groups G1–G13.

Within each strip S1–S4, the first, second, third, and fourth teeth in each row R1 of any one group G1–G13 are in columnar alignment with the first, second, third, and fourth teeth, respectively, of each row R1 in all of the other groups in the strip.

In one embodiment of the array illustrated in FIG. 4, the teeth are preferably arranged so that the spacing X1 is about 0.045 inch, the spacing X2 to is about a 0.0225 inch, the spacing X3 is about 0.035 inch, the spacing X4 is about a 0.0174 inch, the spacing Y1 is about 0.125 inch, and the spacing Y2 is preferably within a range of about 0.031 inch to about 0.093 inch, and preferably is about a 0.040 inch.

The teeth T1 can be formed in the seal 30 by a suitable tool, such as the die 100 illustrated in FIGS. 17–20. Two operations are used in the presently preferred method of forming the teeth. First, the die 100 forms the teeth which face in one direction (e.g., the teeth in all of the rows R1 (FIG. 4)). Second, the die 100 can be reversed to form the teeth which face in the opposite direction (e.g., the teeth in all of the rows R2 (FIG. 4)).

The die 100 includes a plurality of teeth 102 which each have a flat cutting face 104 and a rearwardly angled face 106 diverging from a chisel edge 105. Preferably, the rear face 106 and front face 104 define an included angle of about 70 degrees.

Each tooth 102 has a pair of diverging side surfaces 107. The side surfaces 107 preferably each diverge at an angle of between about 15 degrees and about 20 degrees relative to a plane perpendicular to the edge 105. Each edge 105 preferably has a width of between about 0.010 inch and about 0.025 inch. In one preferred embodiment, the width is 0.015 inch.

The teeth 102 are arranged in groups of four as illustrated in FIG. 18, and there is a clearance notch 108 between pairs of adjacent teeth in each group.

In operation, the die 100 is registered with a flat blank for a seal 30 and engaged with the strap-engaging surface 40 for forming the teeth T1 in each row R1 (FIG. 4). Subsequently, the same die, or a different but identical die, can be oriented in a 180 degree opposite direction and registered with the seal strap-engaging surface 40 to form the teeth T1 in the rows R2.

The die 100 is operated by conventional mechanisms (not illustrated) which form no part of the present invention. The die 100 is initially forced generally perpendicularly into the strap-engaging surface 40 of the seal blank to define the end of the tooth recess 80 having the width G. However, after initially contacting the seal surface 40, the die is then moved generally parallel to the strap-engaging surface to carve the teeth T1 out of the recesses 80. Moreover, as the die 100 moves generally parallel to the strap-engaging surface, it is also moved further inwardly into the seal blank a small amount.

As the die 100 is moved further into the strap-engaging surface 40, the diverging sides 107 of each die tooth 102 are necessarily forced further into the seal so that the width of the recess 80 increases as the die 100 moves into and along the seal. Thus, the recess 80 will have a width H1 near one end which is slightly less than the recess width H2 at the other end. This width difference is exaggerated for illustrative purposes in FIG. 6.

Also, the slight inward movement of the die 100 causes each recess 80 (FIG. 5) to be formed with a slight and generally linear downward slope. In the embodiment of the tooth illustrated in FIG. 5, the depth E at the beginning end of the linear slope of the recess 80 is about 0.004 inch, and the depth F at the end of the recess adjacent the tooth face 84 is about 0.006 inch. This is exaggerated in FIG. 5 for illustrative purposes.

When the die 100 reaches the end of the stroke length, the die is withdrawn from the strap-engaging surface 40 in a generally perpendicular direction. The action of the die, and the geometry of the cutting teeth 102 thereon, serve to cut out and lift up each seal tooth T1 from the recess 80 formed therein. The material forming each seal tooth T1 is essentially lifted up and bent into the desired configuration illustrated in FIGS. 5–7.

Each recess 80 preferably has a length D which does not exceed three times the height C of the tooth T1. In the preferred embodiments, the ratio of the recess length D to the tooth height C does not exceed about 2 to 1.

An alternate form of the tooth configuration that may be employed in the seal of the present invention is illustrated in FIGS. 8–10 wherein each tooth is designated generally by the reference letter T2. The tooth T2 is similar to the first tooth T1 illustrated in FIGS. 5–7 in that the tooth T2 is also formed from material lifted out of a recess 80' in a strap-engaging surface 40'.

The tooth T2 has a solid configuration defined by converging side surfaces which include, in this second embodiment, a curved surface 82' and a planar surface 84'. The surface 84' has a generally trapezoidal configuration as best illustrated in FIG. 10. The surface 84' is defined on the top by an edge 86' and on the bottom by an inside corner or edge 88'. The edges 86' and 88' are parallel. A slanting edge 90' extends between one end of the edge of 86' and one end of the edge of 88', and a slanting edge 92' extends between the other end of the edge 86' and the other end of the edge 88'.

The surface 84' of the tooth T2 is not perpendicular to the strap-engaging surface 40'. Rather, it is disposed at an angle $\beta$ which is preferably between about 10 degrees and about 30 degrees.

The tooth T2 is truncated along a top surface 96'. The top surface 96' preferably has a thickness A of between about 0.003 inch and about 0.005 inch. Preferably, the surface 96' has a width G of about 0.015 inch. The surface 84' and the surface 82' may be characterized as converging toward the top surface 96'. This is illustrated in FIG. 8 which is a cross-sectional view showing the profile of the tooth T2, and the view is taken along a plane normal to the seal strap-engaging surface 40' across the tooth thickness at the mid-point of the tooth width. The tooth profile is defined along this plane by the surface 84' and the curved surface 82' extending from opposite edges of the tooth top surface 96'. The angle $\alpha$ (FIG. 8) is preferably between about 30 degrees and about 60 degrees.

In the preferred configuration of the tooth T2, the height C is between about 0.015 inch and about 0.030 inch. At the base of the tooth, along the strap-engaging surface 40', the tooth preferably has a width H2 of between about 0.020 inch and about 0.025 inch. The tooth thickness B at the tooth base is preferably about 0.025 inch. The recess depth F at the tooth base is preferably between about 0.005 inch and about 0.007 inch, and the depth E of the recess at the beginning of the linear slope is preferably between about 0.003 inch and about 0.005 inch. The width H1 of the recess 80' at the shallow end would be slightly less than the width H2.

The length D of the recess 80' preferably does not exceed three times the height C of the tooth T2. In the preferred embodiment, the ratio of the recess length D to the tooth height C does not exceed about 2 to 1.

The alternate configuration of the teeth T2 illustrated in FIGS. 8–10 may be formed with a tool similar to the die 100 illustrated in FIGS. 17–20 and described above. However, the die is modified as illustrated in FIG. 21 for a die 100' having teeth 102'. The teeth 102' are similar to the teeth 102 for the tool 100 except that the teeth 102' each have a cutting face 104' which is oriented at an angle $\beta$ to correspond with the angle of the seal tooth cutting face 84' (FIG. 8).

The embodiment of the seal tooth T1 illustrated in FIGS. 5–7 exhibits a "directionality" since the tooth face 84 presents a different resistance to strap tension forces than does the angled surface 82. In contrast, the embodiment of the tooth T2 illustrated in FIGS. 8–10 exhibits less such directionality because the tooth surface 84' is angled toward the top surface 96'. If the tooth T2 is formed with the angle $\beta$ equal to the angle $\alpha$, then the differences between the load bearing characteristics of the surface 84' and surface 82' would be minimized. In some applications, such a "non-directional" tooth design could permit more options with respect to the arrangement and layout of the tooth array on a seal.

Where desired, in some cases for appropriate angles $\alpha$ and $\beta$, all rows of such "non-directional" teeth in a seal could be formed in the seal blank by a die moving in only one direction against the seal blank. That is, the die would not have to be reversed 180° after forming a first set of teeth in the seal.

The configuration of the teeth in the embodiments illustrated in FIGS. 5–7 and 8–10 provides an increased joint strength when used in compressable metal seals compared with prior art tooth configurations. FIGS. 11–14 illustrate a tooth previously discussed "50 ASD" seal sold in the U.S.A. by Signode Corporation. The prior art seal is designated generally by reference numeral 130 in FIG. 14 wherein the seal 130 is illustrated in a flat sheet form before the seal margins are deformed to provide the generally flattened C-shaped configuration.

The seal 130 has a strap-engaging surface 140 with a plurality of teeth T3 formed therein. The teeth T3 are arranged in four strips substantially analogous to the strips S1–S4 shown for the flat seal sheet in FIG. 3. The teeth T3 are arranged in groups, such as at G1 and G2 in strip S1, and each group includes a first row R1 of five teeth and a second row R2 of five teeth. The teeth T3 in row R1 are offset, and oppositely facing, from the teeth in row R2. Each strip (e.g. S1) has seven groups (e.g., G1, G2, etc.) which each have two rows R1 and R2 of teeth.

The 50 ASD seal 130 is sold for use with ½ inch wide polypropylene and nylon strap, and the seal length is about 1.151 inch and the flat seal width—when it is flat before the legs are bent to form the generally flattened C-shape configuration—is about 1.038 inch. The teeth T3 are arranged as illustrated in FIG. 14 with the following dimensions:

X1 equal to about 0.025 inch,
X2 to about 0.0125 inch,
X3 equal to about 0.008 inch,
X4 equal to about 0.198 inch, Y1 equal to about 0.125 inch, and Y2 equal to about 0.040 inch.

With the above-described arrangement, there are 140 teeth T3 facing one end of the seal, and 140 teeth T3 facing the other end of the seal.

Each tooth T3 of the conventional seal 130 has a configuration as best illustrated in FIGS. 11-13. Each tooth T3 may be characterized as being "sliver-like." The width H2 of the tooth T3 at its base on the strap-engaging surface 140 is about 0.007 inch, and the depth B is about 0.010 inch. At the other end of the recess, the width H1 may be slightly less than the width H2. The tooth is generally pointed, but may present a slightly flattened point having a width G which may be as great as about 0.005 inch. The exterior surfaces of the tooth T3 converge to a generally sharp or pointed configuration, and the height C of the teeth T3 ranges between about 0.010 inch and about 0.015 inch or higher.

The teeth T3 of the conventional seal 130 are formed with a suitable die in a manner analogous to that described above with respect to the use of the die 100 illustrated in FIGS. 17-20 for forming the tooth structure of the present invention as illustrated in FIGS. 5-10. However, the teeth T3 of the conventional seal 130 are formed from material lifted up from a relatively long and shallow recess 180. The depth F of the recess 180 at the tooth base is about 0.002 inch. The recess slopes upwardly from the base of the tooth very slightly in a generally straight line to a depth E of about 0.001 inch near the other end of the recess 180. For a tooth height C of about 0.01 inch, the recess length D is about 0.060 inch. This yields a recess length to tooth height ratio of about six.

Since the recess 180 is relatively narrow and shallow, the tooth T3 that is formed from the material formerly in the recess is relatively narrow, thin, and sliver-like. As the tooth T3 is being formed by the die, the metal which is being lifted up and bent outwardly from the recess tends to be deformed and somewhat corrugated. In some instances, the tooth T3 may have fractures or other discontinuities along the upwardly projecting, exterior surfaces.

The configuration of each tooth T3 of the conventional seal 130, while generally functioning well for the applications for which it has been designed, does not provide particularly high joint strength when used on polyester strap. The sliver-like teeth T3 function well with softer strap materials, such as nylon or polypropylene, to penetrate the strap material and provide good retention. However, when used with polyester strap, the sliver-like teeth T3 tend to deform, bend, or break rather than penetrate the strap sufficiently. Thus, the joint strength capability with polyester strap is considerably reduced when a seal with such sliver-like teeth is employed.

In contrast, the tooth configuration of the present invention, including the embodiment illustrated in FIGS. 5-7 and the embodiment illustrated in FIGS. 8-10, does not deform, bend, or break when forced into polyester strap. The structure of the teeth T1 and T2 illustrated in FIGS. 5-10 provides a more homogeneous engaging surface with few or no corrugations or fractures.

Further, the tooth structure of the present invention, which has a much lower ratio of recess length to tooth height, withstands the increased forces necessary for penetrating the harder strap material. However, the width of the improved tooth configuration is not so great as to prevent the necessary penetration of the tooth into the harder strap material.

The tooth structure of the present invention has been tested and compared with the conventional seal tooth structure, and the results are tabulated in FIGS. 22A and 22B. Seals were fabricated for testing with polyester strap having a width of $\frac{5}{8}$ inch and a thickness of 0.033 inch. All of the tested seals were initially formed from the basic flat sheet shape illustrated in FIG. 3 with the indicated dimensions as shown in FIG. 22A and with the number of groups G of teeth in each strip S1-S4 as listed in FIG. 22B.

Figure 15:
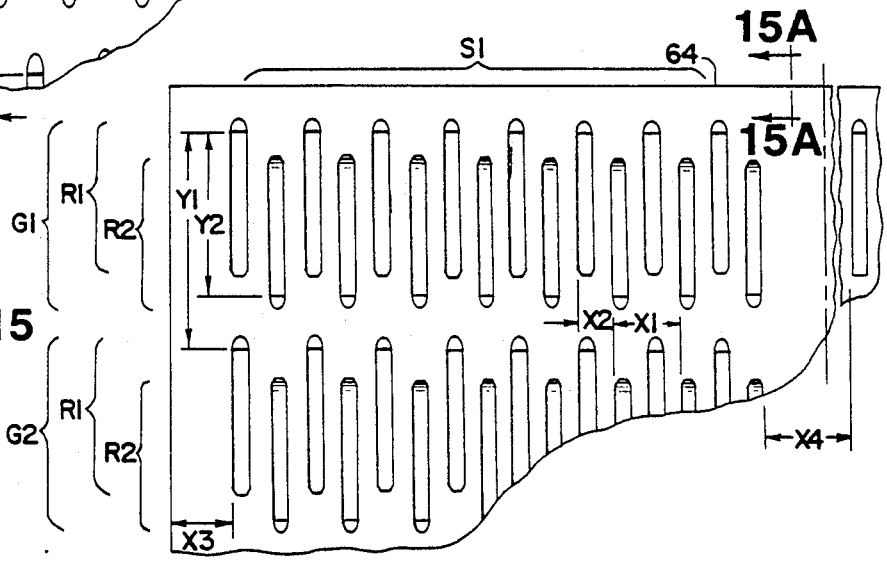
FIG. 15 is a view similar to FIG. 14 but showing another arrangement of prior art teeth on a seal blank.

For test purposes, the sliver-like teeth of the type used in the conventional seal 130 illustrated in FIG. 14 were formed in a flat seal sheet having the configuration shown in FIG. 3 but with a tooth array as illustrated in FIG. 15 rather than FIG. 14. The conventional teeth were provided in 20 groups in each strip S1-S4 (rather than 13 groups shown in FIG. 3 for the present invention tooth configuration). Such seals with conventional sliver tooth profiles for two different tooth heights C were formed and tested as indicated under "Type 1" and "Type 2" in the first and second columns, respectively, of FIGS. 22A and 22B.

For the conventional tooth profile test specimens, each row R1 (in FIG. 15) has eight teeth, and each row R2 has eight teeth. The other dimensions shown in FIG. 15 are set forth in the tabulation in FIG. 22B for the tested seal configuration type 1 and seal configuration type 2 (column 1 and column 2, respectively, in FIG. 22B).

FIG. 22A lists the tooth height C as a range for the tested type 1 and 2 seals. The tested seal specimens of type 1 each had tooth heights ranging between 0.020 inch and 0.025 inch, and the tested seal specimens of type 2 each had tooth heights ranging between 0.015 inch 0.020 inch. These were formed by dies operated at between about 175 psig and about 200 psig. Tests for specimens with conventional sliver-like tooth configurations having lesser tooth heights are not listed in FIGS. 22A and 22B, but the test result joint strengths were less than those listed for types 1 and 2.

Seals embodying the tooth configuration of the present invention were tested, and the data relating to them is set forth in the columns for seal types 3, 4, 5, and 6. Seal test specimens for types 3 and 5 used the tooth configuration illustrated in FIGS. 5-7 (and formed by dies operated at between about 175 psig and about 200 psig), and the seal test specimens for types 4 and 6 used the tooth configuration illustrated in FIGS. 8-10 (and formed by dies operated at between about 250 psig and about 300 psig). For the type 4 and type 6 test seals, the Y2 dimension was measured at the tops of the teeth.

All of the test specimen seals, which had the same size, were applied to overlapping portions of the previously described "16 mm High Strength Tenax" brand polyester strap having a nominal width of about $\frac{5}{8}$ inch and a nominal thickness of about 0.034 inch. All of the seals were closed about the strap portions with the same tool to produce identical closed seal configurations.

The sealed joints were then tested by pulling on the overlapping strap portions in opposite directions. The specimens of the seal configuration types 1 and 2 failed within the tension ranges listed in the last row of the tabulation (FIG. 22B)—and this failure was manifested by relative slippage occurring between the strap and the seal. In some cases the sliver-like teeth were deformed and bent over as the strap slipped.

On the other hand, for the seal types 5 and 6 which incorporate an embodiment of the tooth configuration of the present invention, the joints failed by complete rupture of one of the strap portions at one of the end edges of the seal.

For the type 3 and 4 seal specimens which incorporate another embodiment of the tooth configuration of the present invention, the joints failed sometimes by the strap slipping relative to the seal and sometimes by the strap breaking at the end edge of the seal.

As can be seen in the second last line of the tabulation in FIG. 22B, the joint strength for the improved tooth configuration type 3 and 4 seals ranged between 678 pounds and 760 pounds (wherein the height of the teeth on each tested seal ranged between 0.016 inch and 0.019 inch). The joint strength for the improved tooth configuration type 5 and 6 seals ranged between 860 pounds and 910 pounds (wherein the height of the teeth on each tested seal ranged between 0.019 inch and 0.023 inch). The last line of the tabulation in FIG. 22 B lists the joint strength in terms of a percentage of the rated tensile strength of the strap.

It can be seen by comparing the joint strength results in the second last line of FIG. 22B that the maximum joint strength achieved with a sliver-like conventional tooth structure was 620 pounds (for the type 1 configuration with a tooth height C of between 0.020 inch and 0.025 inch). This is less than the lowest joint strength for the improved seal tooth types 3 and 4 and is considerably less than the improved seal tooth types 5 and 6.

The test data shows that the joint strength which can be obtained with forms of the improved tooth configuration (types 3, 4, 5, and 6) falls within a range of about 60% to about 79% of the rated tensile strength of the strap. For the greater height tooth configuration type 5 and 6 seals, the joint strength falls within a range of 75% to 79%. For polyester strap, this is a significant improvement compared to the joint strengths obtained with conventional grit-type seals that are sold by Signode Corporation for use with polyester strap and that exhibit joint strengths within the range of only 50% to 65% of the strap tensile strength.

FIG. 22A shows that for the greater tooth height embodiments of the invention (types 5 and 6), the depth F of the tooth trough or recess (80 or 80') is greater than the recess depth F for the shorter teeth (types 3 and 4). Further, the taller teeth (types 5 and 6) have a recess length D that is less than the recess length D of the shorter teeth (types 3 and 4). The taller teeth have a lesser recess length D because of the greater depth E of the recess from which more material is removed to form the taller teeth. This provides an even stronger tooth structure as shown by the joint strength test results in the last two rows of FIG. 22B.

The novel tooth configuration of the present invention permits the teeth to be formed in the seal in a variety of arrays. FIG. 4 shows an example of one such array.. In such an array, transversely spaced teeth partially overlap each other in the longitudinal direction. For example, a portion of each tooth in the row R2 of group G3 extends between a portion of two transversely spaced teeth from row R1 of group G4.

With the tooth configuration of the present invention, it is possible to position a tooth from one row of one group at any point longitudinally relative to the teeth in an adjacent row of an adjacent group. This is possible because the tooth configuration can be formed with a die such as the die 100 discussed above with reference to FIGS. 17–20. As illustrated in FIG. 20, there is sufficient clearance (at 108) between adjacent forming teeth 102 of the die 100 so that the die 100 can be moved against the seal in one direction to form teeth facing in one direction while clearing existing, oppositely facing teeth which had been previously formed by a suitable die moving in the opposite direction. The capability of the die 100 to accommodate the previously formed rows of teeth is illustrated in FIG. 20 wherein the clearance notch 108 of the tool die 100 is shown passing over an existing tooth T. Therefore, the later formed teeth can be located on the seal at any desired longitudinal position relative to the previously formed teeth.

In contrast, with the conventional dies used for forming the above-discussed 50 ASD seal 130, the die does not have sufficient clearance to pass over previously formed teeth.

Figure 16:
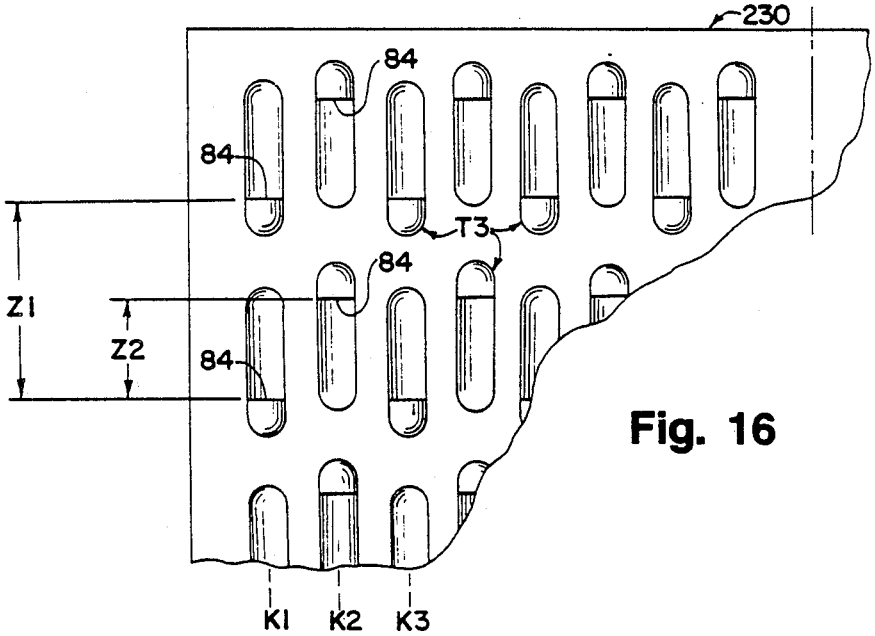
FIG. 16 is a view similar to FIG. 15 but showing an alternate arrangement of the present invention seal teeth illustrated in FIGS. 5-7.

Another array that may be employed with the improved tooth configuration of the present invention is illustrated in FIG. 16 for a seal 230 wherein each tooth T3 has a configuration substantially identical to that illustrated for the tooth T1 in FIGS. 5–7. In the array illustrated in FIG. 16, the teeth T3 are provided in columns such as indicated at column K1, column K2, and column K3. The teeth in column K1 are oriented so that the planar surface 84 of each tooth in column K1 faces one end of the seal, and the teeth in column K2 are oriented so that the tooth surfaces 84 of the column K2 teeth face the other end of the seal.

The distance between the tooth surfaces 84 of two adjacent teeth in column K1 is indicated by reference letter Z1. Preferably, the Z1 dimension is about 0.125 inch. The adjacent teeth in all of the columns have the same spacing. However, the adjacent columns are offset so that the teeth in column K2 are staggered relative to the teeth in column K1. Thus, the top of the upwardly projecting surface 84 of a tooth in column K2 lies at distance Z2 from the top of the surface 84 of the oppositely facing adjacent tooth in column K1. In a presently contemplated commercial embodiment, Z2 may lie in a range of about 0.045 inch to about 0.075 inch, but is preferably in a range of about 0.067 inch to about 0.087 inch. This latter range results in locating the teeth in one row generally longitudinally midway between the teeth in the two adjacent rows.

The uniform, staggered array of teeth T3 in FIG. 16 demonstrates how the spacing between the teeth T3 on the seal 230 can be maximized for a given tooth structure. This array has the beneficial effect of minimizing the stress concentrations caused by teeth being too close together in a uniform array while still providing a substantially uniform stress distribution in the strap. This is a preferred array which is presently contemplated for commercial applications with the harder polyester thermoplastic strap having a thickness of about 0.034 inch and a width of about ⅝ inch.

It will be readily observed from the foregoing detailed description of the invention and from the illustrations thereof that numerous variations and modifications may be effected without departing from the true spirit and scope of the novel concepts or principles of this invention.

What is claimed is:

1. A seal for joining a pair of overlapping plastic strap portions comprising:

a body of sheet material having a strap-engaging surface on one side; at least a portion of said body thickness on said one side having a hardness which exceeds the hardness of said plastic strap; said body being sufficiently ductile at least along a bend region to accommodate deformation of said body at said bend region to permit closure of said seal about said strap portions with said strap-engaging surface in engagement therewith; said body having a plurality of teeth upset from said strap-engaging surface; each said tooth being formed of material displaced outwardly from said strap-engaging surface to define a recess therein; each said tooth having a solid configuration defined by converging side surfaces and truncated along a flat top surface substantially parallel to the portion of said strap-engaging surface that is immediately adjacent to said tooth; and the ratio of the length of each said tooth recess to the height of said tooth above said strap-engaging surface being within the range of about 1 to 1 to about 3 to 1.

2. The seal in accordance with claim 1 in which said sheet material includes a generally rectangularly shaped central portion and a pair of generally rectangularly shaped legs each interconnected to the central portion by a longitudinally extending bend region.

3. The seal in accordance with claim 2 in which said teeth are arranged in an array of said sheet material, said array including said teeth being arranged in plurality of groups, each group including (1) a first set of four teeth spaced-apart in a first row with the associated recesses extending in a first direction parallel to said bend region, and (2) a second set of four teeth spaced-apart in a second row with the associated recesses extending in a second direction opposite to said first direction and parallel to said bend region, said first set of teeth being longitudinally offset relative to said second set of teeth in said second direction to define a staggered arrangement, said teeth of said first set alternating transversely across said seal with said teeth of said second set, said groups of teeth being arranged in four spaced-apart strips parallel to said bend line with each leg having one of said strips and said central portion having two of said strips, and each said strip including at least twelve- of said groups.

4. The seal in accordance with claim 1 in which said teeth each have a generally upright surface projecting from said recess and being substantially perpendicular to the immediately adjacent portion of said strap-engaging surface.

5. The seal in accordance with claim 4 in which said upright surface has a generally planar trapezoidal shape defined by two generally parallel edges and two edges slanting toward each other.

6. The seal in accordance with claim 1 in which said teeth each have one substantially trapezoidal side surface, and one curved side surface.

7. The seal in accordance with claim 1 in which the cross-sectional profile of each tooth taken along a plane normal to the sheet material across the tooth thickness at the midpoint of the tooth width is defined by two surfaces extending from opposite edges of said tooth top surface at an included angle of between about 30 degrees and about 60 degrees.

8. The seal in accordance with claim 1 in which the thickness of each said tooth at said strap-engaging surface is between about 0.015 inch and about 0.025 inch.

9. The seal in accordance with claim 1 in which the thickness of each said tooth at said top surface is between about 0.003 inch and about 0.005 inch.

10. The seal in accordance with claim 1 in which the width of each said tooth at said strap-engaging surface is between about 0.015 inch and about 0.025 inch.

11. The seal in accordance with claim 1 in which the width of each said tooth at said top surface is between about 0.010 inch and about 0.020 inch.

12. The seal in accordance with claim 1 in which said teeth each have a height above said strap-engaging surface between about 0.015 inch and about 0.030 inch.

13. The seal in accordance with claim 1 in which said teeth each have a generally planar side surface projecting upwardly at an angle of between about 10 degrees and about 30 degrees from a plane perpendicular to the immediately adjacent portion of said strap-engaging surface.

14. The seal in accordance with claim 1 in which said recesses each have a depth which decreases from about 0.006 inch at the base of an associated adjacent tooth to about 0.004 inch at the end of said recess furthest from said tooth.

15. A seal for joining a pair of overlapping plastic strap portions comprising:

A body of sheet material having a strap-engaging surface to engage said strap portions when said seal is closed about said strap portions; said body having a plurality of teeth projecting from said strap engaging surface; each said tooth being formed of material displaced outwardly from said strap-engaging surface to define a recess therein; each said tooth having a solid configuration defined by converging side surfaces and truncated along a top surface, said top surface of each said tooth is generally flat and parallel to the portion of the strap-engaging surface that is immediately adjacent to said tooth; and said teeth each have one substantially trapezoidal side surface and one curved side surface.

16. The seal in accordance with claim 15 in which the cross-sectional profile of each tooth taken along a plane normal to the sheet material across the tooth thickness at the midpoint of the tooth width is defined by two surfaces extending from opposite edges of said tooth top surface at an included angle of between about 30 degrees and about 60 degrees.

17. The seal in accordance with claim 15 in which said teeth are arranged in an array of said sheet material, said array including said teeth being arranged in plurality of groups, each group including (1) a first set of four teeth spaced-apart in a first row with the associated recesses extending in a first direction parallel to said bend region, and (2) a second set of four teeth spaced-apart in a second row with the associated recesses extending in a second direction opposite to said first direction and parallel to said bend region, said first set of teeth being longitudinally offset relative to said second set of teeth in said second direction to define a staggered arrangement, said teeth of said first set alternating transversely across said seal with said teeth of said second set, said groups of teeth being arranged in four spaced-apart strips parallel to said bend line, and each said strip including a plurality of said groups.

* * * * *